US006024596A

United States Patent [19]

Tanaka et al.

[11] Patent Number: 6,024,596

[45] **Date of Patent: *Feb. 15, 2000**

[54] JOINT STRUCTURE OF FLAT CABLE AND JOINT TERMINALS

[75] Inventors: Yoshiyuki Tanaka; Shinobu Mochizuki, both of Shizouka, Japan

[73] Assignee: Yazaki Corporation, Tokyo, Japan

[ * ] Notice: This patent is subject to a terminal disclaimer.

[21] Appl. No.: 09/017,855

[22] Filed: Feb. 3, 1998

Related U.S. Application Data

[63] Continuation-in-part of application No. 08/794,778, Feb. 3, 1997.

[30] Foreign Application Priority Data

Feb. 5, 1997 [JP] Japan ..... 9-022944

[51] Int. Cl.[7] ..... H01R 9/07

[52] U.S. Cl. ..... 439/492

[58] Field of Search ..... 439/492, 493, 439/495, 497, 499, 604, 606, 329, 936

[56] References Cited

U.S. PATENT DOCUMENTS 3,462,542 8/1969 Richter ..... 174/88
5,147,510 9/1992 Iura et al. ..... 439/495
5,389,741 2/1995 Ueno ..... 439/499

FOREIGN PATENT DOCUMENTS 6-30270 4/1994 Japan .

*Primary Examiner*—Khiem Nguyen
*Assistant Examiner*—V. Johnson
*Attorney, Agent, or Firm*—Armstrong, Westerman, Hattori, McLeland & Naughton

[57] ABSTRACT

A joint structure of a flat cable and joint terminals is provided. In this structure, bus bars are arranged in conformity with the arrangement pitch of the conductors. A bus bar holder is formed by securing the conforming side of the bus bars by a first bus bar resin layer formed of an insulating resin. The conductors are laminated and welded between terminal plates and bus bars held by the bus bar holder. An insulating coating layer of the flat cable is interposed between a first terminal resin layer and a first bus bar coating layer. The bus bar holder also includes a second bus bar resin layer formed of an insulating resin at the other side of the bus bars, and a tip coating layer remaining at the front edges of the conductors of the flat cable is interposed between the second terminal resin layer and the second bus bar resin layer. Furthermore, an insertion groove into which the tip coating layer is inserted is formed on the second bus bar resin layer or the second terminal resin layer. Thus, the connection region of the flat cable and joint terminals can be protected from pulling force.

12 Claims, 7 Drawing Sheets

JOINT STRUCTURE OF FLAT CABLE AND JOINT TERMINALS

CROSS-REFERENCE TO RETALTED APPLICATIONS

This application is a continuation-in-part application of an U.S. patent application Ser. No. 08/794,778 filed on Feb. 3, 1997.

BACKGROUND OF THE INVENTION

1. Field of the Invention

The present invention relates to a joint structure of a flat cable (more specifically, flexible flat cable (FFC)) in a signal transmission device for a vehicle steering mechanism and joint terminals.

2. Description of the Prior Art

Generally, a signal transmission device for a vehicle steering mechanism is used to transfer a signal between a rotary portion which is rotated with a steering wheel and a fixed portion still regardless of the rotation of the steering wheel. In order to transfer the signal from the rotary portion to the external fixed portion, the first end of a flat cable is connected to the rotary portion whereas the other end thereof is connected to the fixed portion through a connector. The second end of the flat cable is connected to the connector in such a manner that the second end of the flat cable is connected to the first ends of joint terminals and the second ends of the joint terminals are inserted into the connector.

A previously known joint structure a of a flat cable and joint terminals is such as shown in FIG. 7.

As seen from FIG. 7, a plurality of joint terminals b include first areas b1 which are terminal plates and second areas b2 which are connector terminals. Conductors c2 exposed by stripping the coating of an insulating coating layer c1 from a flat cable c is welded to the terminal plates b1 by e.g. ultrasonic welding. The connector terminal areas b2 are secured within a terminal chamber d for the connector. A region e where the terminal plates b1 and the conductors c2 are connected is molded by insulating resin. This mold structure is sandwiched between and held by an upper case f1 and a lower case f2. The upper case f1 and lower case f2 are secured by locking to create the joint structure a of the flat cable c and the joint terminal b.

Another joint structure of the flat cable and the joint terminals as shown in FIG. 8 is disclosed in Japanese Paten Publn. 6-30270.

In FIG. 8, the first ends of a plurality of joint terminals b, i.e., the terminal plates b1, are arranged according to the arrangement pitch of conductors c2 whereas the second ends thereof, i.e. the connector terminals b2 are arranged to extend within the terminal chamber d. The terminal plates b1 and the connector terminals b2 are secured by insulating layers h1 and h2, respectively to create a terminal holder g.

The terminal plates b1 are welded to the conductor c2 by e.g. ultrasonic welding. A region e' where the terminal plates b1 and the conductors c2 are sandwiched and held by the upper case f1 and the lower case f2. The upper case f1 and lower case f2 are secured by locking to create the joint structure a' of the flat cable c and the joint terminals b.

The above two joint structures described above have the following drawbacks.

Since the connecting section e (e') is only sandwiched by both upper and lower cases f1 and f2, the mechanical strength of attaching the former to the latter is relatively low.

The force for holding the connecting section e (e') by both cases f1 and f2 is also small. When the flat cable c is pulled, owing to the small holding force, pulling force is apt to concentrate on the connecting section. Thus, the connecting section e (e') may suffer from direct force so that it is destroyed. Further, since the upper case f1 and lower case f2 are secured by locking, when the flat cable c is pulled, both cases f1 and f2 may be loosed. This produces unexpected force which may destroy the connecting section e (e').

SUMMARY OF THE INVENTION

An object of the present invention is to provide a joint structure which permits stabilized connection of a flat cable and a joint terminal.

In accordance with one aspect of the present invention, a joint structure of a flat cable and joint terminals comprises: a flat cable having a plurality of conductors at its front and an insulating coating layer at its rear; a plurality of joint terminals having terminal plates at their first ends, the terminal plates being arranged in conformity with an arrangement pitch of the conductors; a terminal holder including a first terminal resin layer and holding the joint terminals in such a manner that the first ends of the terminal plates are secured by the first terminal resin layer; a bus bar holder including a first bus bar resin layer and holding a plurality of bus bars whose first ends are arranged in conformity with the arrangement pitch of the conductors in such a manner that the first ends of the bus bars are secured by the first bus bar resin layer; the conductors being sandwiched by and welded to the terminal plates and the bus bars held by the bus bar holder; and the insulating coating layer of the flat cable being sandwiched and secured by the first terminal resin layer and the first bus bar resin layer.

Thus, since the conductors of the flat cable is sandwiched by and welded to the terminal plates of the terminal holder and the bus bars of the bus bar holder, the insulating coating layer of the flat cable is sandwiched and held by the first terminal resin layer of the terminal holder and the first bus bar resin layer of the bus bar holder. Thus, even when the flat cable is pulled, the welded section can be stabilized.

In a joint structure of a flat cable and joint terminals according to another aspect of the present invention, the terminal holder further includes a second terminal resin layer and holds the joint terminals in such a manner that both ends of the joint terminals are secured by the first terminal resin layer and the second terminal resin layer, the bus bar holder further includes a second bus bar resin layer and holds the bus bars in such a manner that both ends of the bus bars are secured by the first bus bar resin layer and the second bus bar resin layer, the flat cable has a tip insulating coating layer remaining on the tips of the conductors, and the tip insulating coating layer is sandwiched and held by the second terminal resin layer and the second bus bar resin layer.

In this structure, since the tip coating layer left at the tip of the conductors of the flat cable is sandwiched by the second terminal resin layer and the second bus bar resin layer. Thus, the welded section can be further stabilized.

In a joint structure of a flat cable and joint terminals according to yet another aspect of the present invention, the terminal holder further includes a second terminal resin layer and holds the joint terminals in such a manner that both ends of the joint terminals are secured by the first terminal resin layer and the second terminal resin layer, the bus bar holder further includes a second bus bar resin layer and holds the bus bars in such a manner that both ends of the bus bars are secured by the first bus bar resin layer and the second bus bar resin layer, the flat cable has a tip insulating coating layer remaining on the tips of the conductors, and the tip insulating coating layer is inserted into an insertion groove formed on the second terminal resin layer or the second bus bar resin layer.

In this joint structure, the flat cable is attached to the bus bar holder and the terminal holder, with the tip insulating coating layer being inserted into the insertion groove formed on the second bus bar resin layer facing the terminal holder or on the second terminal resin layer facing the bus bar holder. Thus, the flat cable is temporarily secured to either the bus bar holder or the terminal holder by inserting the tip insulating coating layer into the insertion groove.

The above and other objects and features of the present invention will be more apparent from the following description taken in conjunction with the accompanying drawings.

DESCRIPTION OF THE PREFERRED EMBODIMENTS

An explanation will be given of the case where in a signal transmission device for a vehicle steering mechanism, in order to transfer a signal from a rotary portion rotating with a steering wheel to an external fixed portion, the one end of the flat cable is connected to the rotary portion whereas the other end thereof is connected to the fixed portion through a connector.

EMBODIMENT 1

FIGS. 1 to 4 show the first embodiment of a flat cable and joint terminals according to the present invention.

Figure 1:
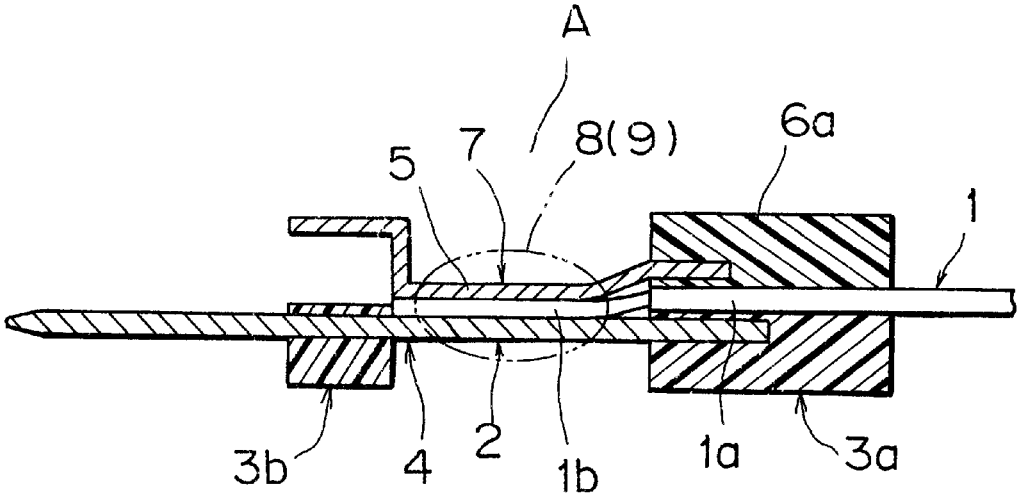
FIG. 1 is a longitudinal cross sectional view of a first embodiment of a flat cable and joint terminals according to the present invention.
Figure 2:
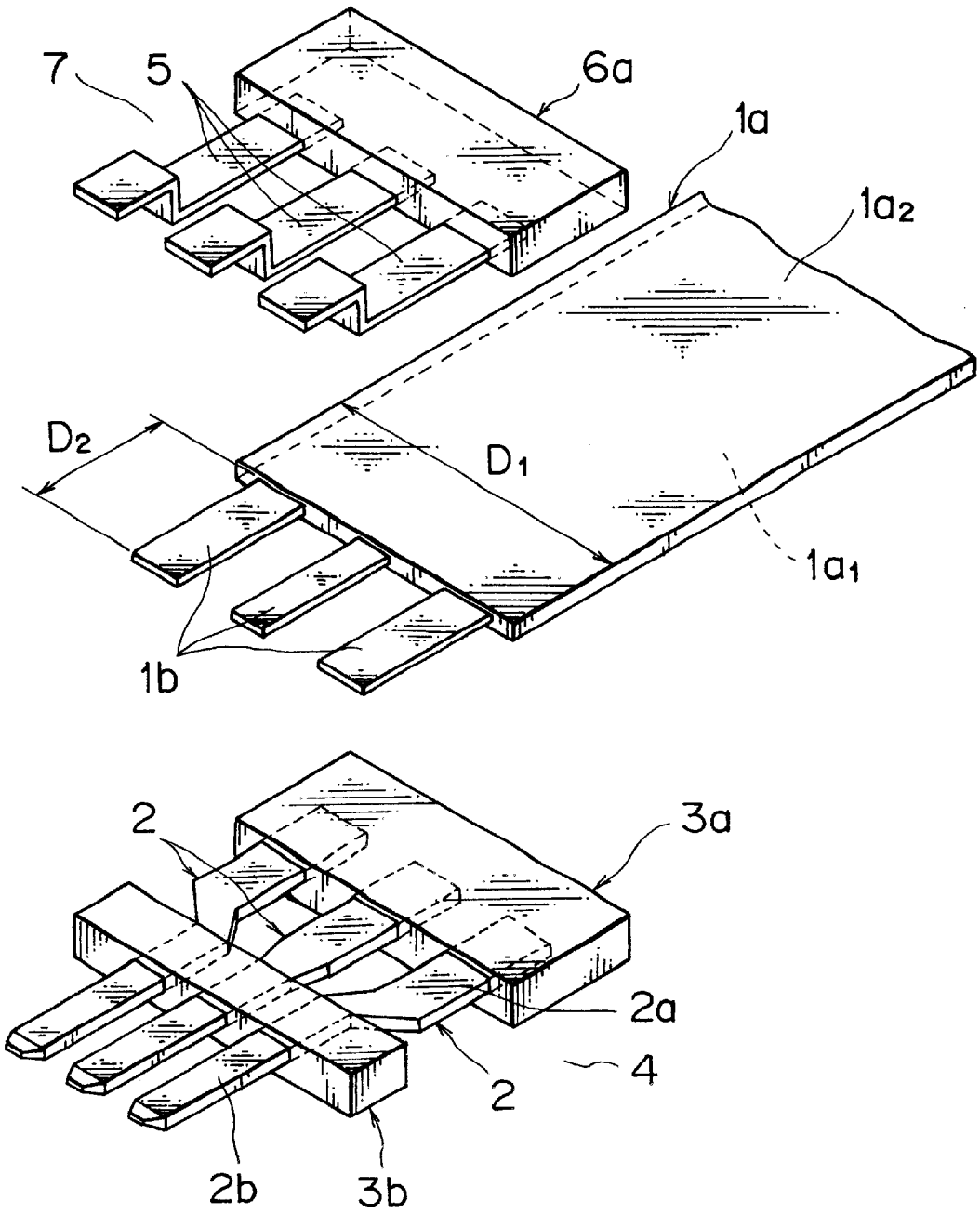
FIG. 2 is an exploded perspective view of the joint structure.

In FIGS. 1 and 2, a joint structure A includes a plurality of conductors 1*b*, a terminal holder 4 and bus bar holder 7. The conductors 1*b* are exposed by stripping the insulating coating layer of the one end of a flat cable 1. The terminal holder 4 holds a plurality of joint terminals 2 in such a manner that they are integrally secured by a first insulating resin layer 3*a* and a second insulating resin layer 3*b*.

The bus bar holder 7 holds a plurality of bus bars 5 in such a manner that they are secured by a first insulating resin layer 6*a* (bus bar resin layer). The flat cable 1 is sandwiched by the terminal holder 4 and the bus bar holder 7. A laminated region 8 including the joint terminals 2, conductors 1*b* and bus bars 5 is welded by ultrasonic welding, crimping, soldering, etc. to constitute a connection region 9. In addition, the coating layer 1*a* is sandwiched and held by the first terminal resin layer 3*a* and the first bus bar resin layer 6*a*.

As shown in FIG. 2, the flat cable 1 has a plurality of conductors 1*b*.

Figure 3:
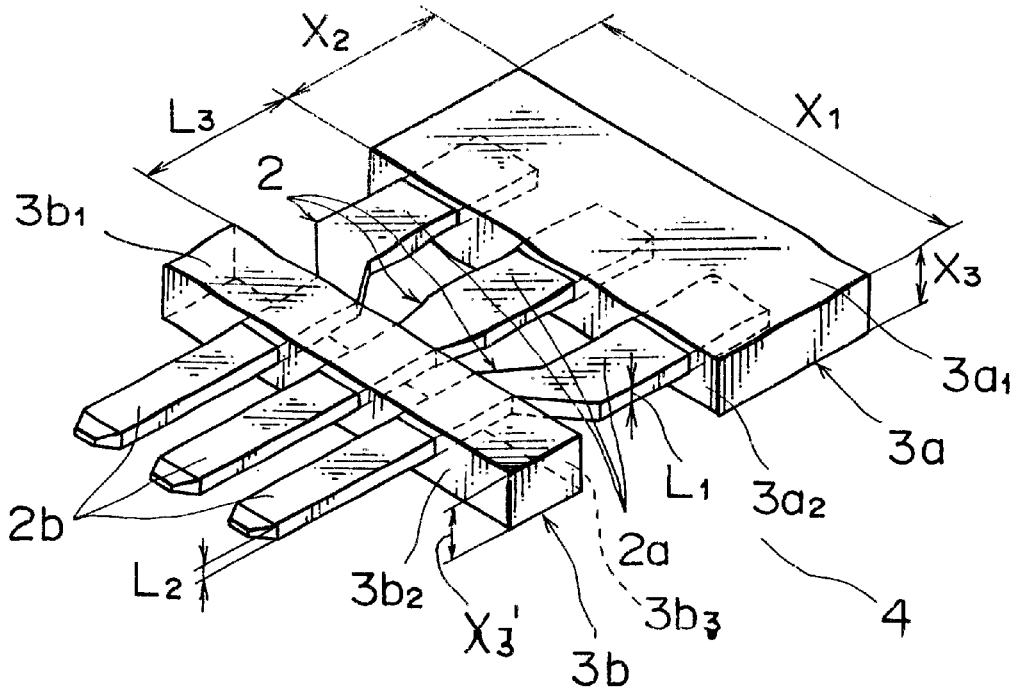
FIG. 3 is an enlarged perspective view of a terminal holder.

The terminal holder 4, as shown in FIG. 3, holds the joint terminals 2 as follows. The first ends 2*a* (terminal plates) of the plurality of joint terminals 2 are arranged to accord with the arrangement pitch of the conductors 1*b* whereas the second ends (connector terminals) 2*b* thereof are arranged to correspond to the terminal chamber d (see FIG. 7 or FIG. 8). The first ends 2*a* and second ends 2*b* are secured by the first terminal resin layer 3*a* and the second resin layer 3*b* in a direction perpendicular to the longitudinal direction of the joint terminals 2, respectively.

The upper wall 3*a*1 of the first terminal resin layer 3 is formed so as to conform with the lower surface 1*a*1 of the coating layer 1*a*, and the terminal plates 2*a* are secured to the front wall 3*a*2 of the first terminal resin layer 3*a* at its upper position. The most optimum position is in the vicinity of the upper wall 3*a*1 of the front wall 3*a*2. The width X1 of the upper wall 3*a*1 is preferably not smaller than the width D1 of the coating layer 1*a* (FIG. 1), i.e., X1 D1. The length X2 of the upper wall 3*a*1 is set for a desired length. The thickness X3 of the first terminal resin layer 3*a* is preferably not smaller than the thickness L1 of the terminal plates 2*a*, i.e., X3 L1.

The connector terminals 2*b* are penetrated and secured between the front wall 3*b*2 and the rear wall 3*b*3 of the second terminal resin layer 3*b* at their upper positions. The thickness X3' of the second terminal resin layer 3*b* is preferably larger than the thickness L2 of the connector terminals 2*b*, i.e., X3'>L2. The interval L3 between the first terminal resin layer 3*a* and the second terminal resin layer 3*b* is approximately equal to the length D2 of the conductors 1*b*, i.e., L3 D2.

Figure 4:
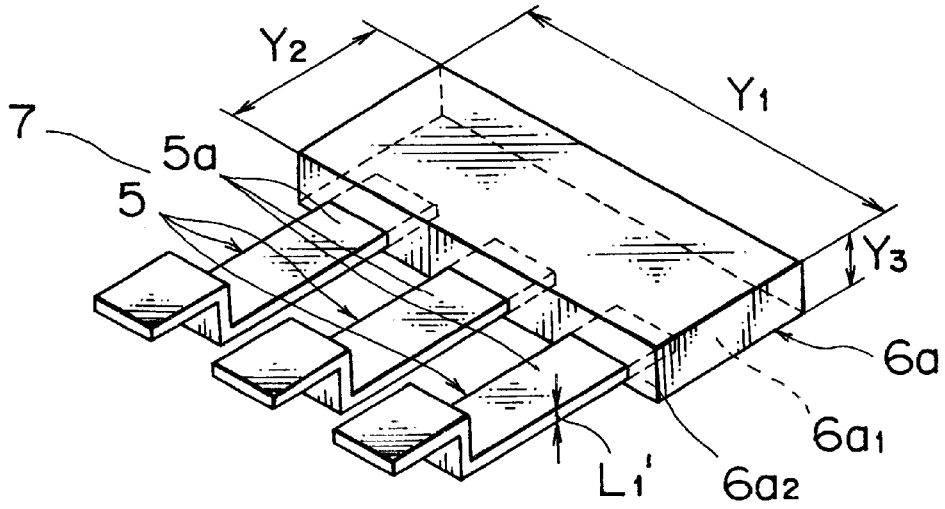
FIG. 4 is an enlarged perspective view of a bus bar holder.

The bus bar holder 7, as shown in FIG. 4, holds the plurality of bus bars 5 as follows. The first ends 5*a* of the plurality of bus bars 5 are arranged so as to accord with the arrangement pitch of the conductors 1*b*. In addition, the plurality of bus bars 5 are secured by a first bus bar resin layer 6*a* in a direction perpendicular to the longitudinal direction of the bus bars 5.

The lower surface 6*a*1 of the first bus bar resin layer 6*a* is formed so as to conform with the upper surface 1*a*2 of the coating layer 1*a*, and the first ends of the bus bars 5 are secured to the front wall 6*a*2 of the first bus bar resin layer 6*a* at its lower position. The most optimum position is in the vicinity of the lower surface 6*a*1 of the front wall 6*a*2. The width Y1 of the lower surface 6*a*1 is preferably not smaller than the width D1 of the coating layer 1*a* (FIG. 1), i.e., X1 D1. The length Y2 of the lower surface 6*a*1 is set for a desired length. The thickness Y3 of the first bus bar resin layer 6*a* is preferably not smaller than the thickness L1' of the first ends of the bus bars, i.e., X3 L1'. In this embodiment, although the second ends of the bus bars 5 are not secured by insulating resin, they may be secured.

The process of forming the joint structure A will be explained.

First, the terminal plates 2*a* of the terminal holder 4 and the conductors 1*b* of the flat cable 1 are lied on each other, and the coating layer 1*a* of the flat cable 1 is placed on the upper wall 3*a*1 of the first terminal resin layer 3*a*. Next, the bus bars 5 of the bus bar holder 7 and the conductors 1*b* of the flat cable 1 are lied on each other. The lower surface 6*a*1 of the first bus bar resin layer 6*a* is placed on the coating layer 1*a*. Thus, the laminated region 8 composed of the conductors 1*b*, terminal plate 2*a* and bus bars 5 is formed. Finally, the laminated region 8 is subjected to welding by ultrasonic welding to form the connection region 9. In addition, the coating layer 1*a* is sandwiched and held by the upper wall 3*a*1 and the lower surface 6*a*1. Thus, the joint structure A is completed.

In the above structure, the coating layer 1*a* of the flat cable 1 is sandwiched by the upper wall 3*a*1 of the first terminal resin layer 3*a* and the lower surface 6*a*1 of the first bus bar resin layer 6*a*. For this reason, even if the flat cable 1 is pulled, the conductors la will not be disconnected from the joint structure A. Thus, the strength of the joint structure A against pulling of the flat cable 1 is increased so that the connection region 9 is prevented from being destroyed. This enhances the reliability of the joint structure as a product.

EMBODIMENT 2

Figure 5:
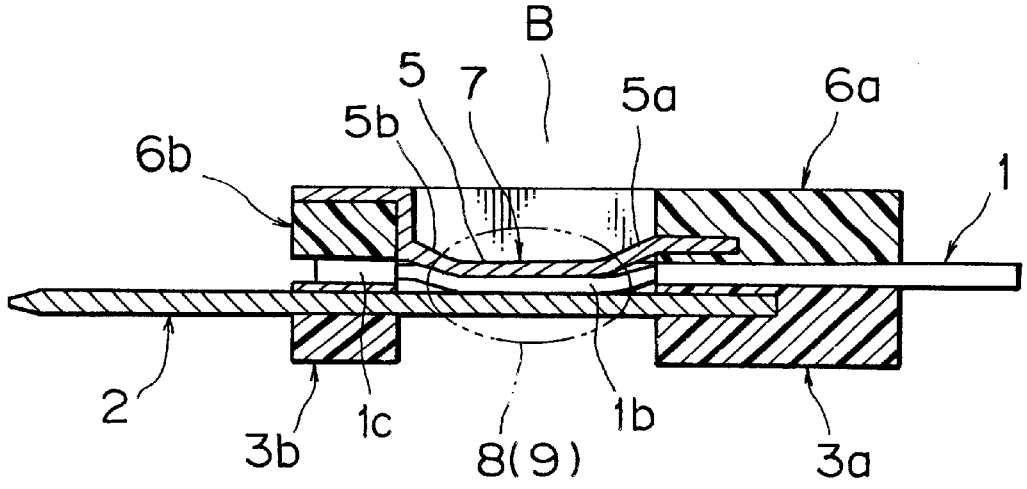
FIG. 5 is a longitudinal cross sectional view of a second embodiment of a joint structure of a flat cable and joint terminals according to the present invention.
Figure 6:
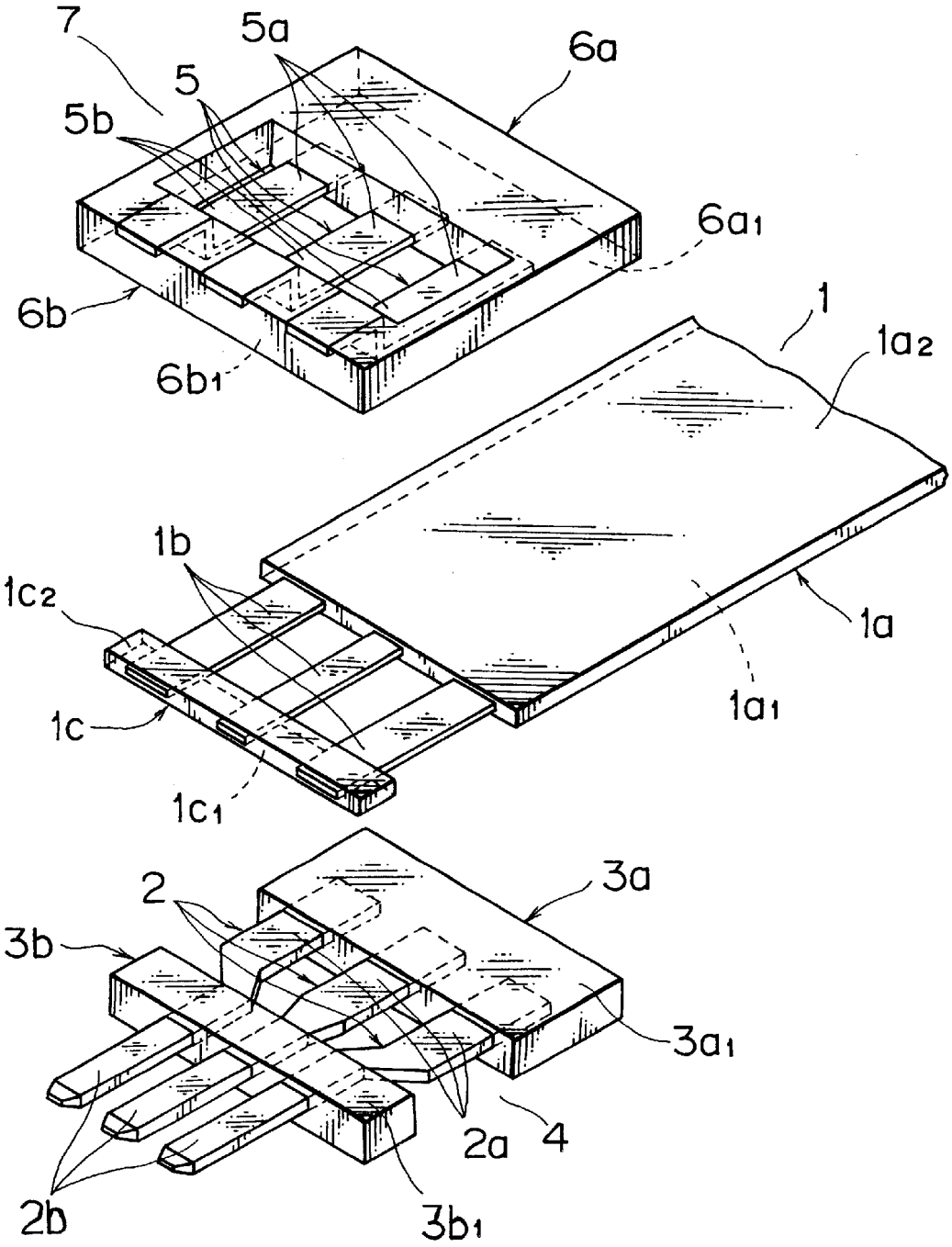
FIG. 6 is an exploded perspective view of the joint structure.

FIGS. 5 and 6 show the second embodiment of a joint structure of a flat cable and joint terminals according to the present invention. In this embodiment, like reference numerals refer to like elements in the first embodiment.

In FIGS. 5 and 6, a joint structure B is similar to the joint structure A shown in FIGS. 1 and 2 in that it includes a plurality of conductors 1*b*, a terminal holder 4 and bus bar holder 7, but is different from latter in that the bus bar holder 7 has a second bus bar resin layer 6*b* at the second end of the bus bars 5 and a tip coating layer 1*c* is left at the tip of the conductors 1*b* of the flat cable 1.

The flat cable 1 is sandwiched by the terminal holder 4 and the bus bar holder 7. The laminated region 8 composed of the conductors 1*b*, joint terminals 2 and bus bars 5 is subjected to welding by ultrasonic welding to form the connection region 9. In addition, the coating layer 1*a* is sandwiched and held by the first terminal resin layer 3*a* and the first bus bar resin layer 6*a*, and the tip coating layer 1*c* is sandwiched and held by the second terminal resin layer 3*b* and a second bus bar resin layer 6*b*.

The upper wall 3*b*1 has a shape conforming to that of the lower surface 1*c*1 of the tip coating layer 1*c*, and the lower wall 6*b*1 of the second bus bar resin layer 6 has a shape conforming to that of the upper surface 1*c*2 of the tip coating layer 1*c*. The process of forming the joint structure B will be explained.

As shown in FIG. 6, the terminal plates 2*a* of the terminal holder 4 and the conductors 1*b* of the flat cable 1 are lied on each other, and the coating layer 1*a* of the flat cable 1 is placed on the upper wall 3*a*1 of the first terminal resin layer 3*a*. Next, the bus bars 5 of the bus bar holder 7 and the conductors 1*b* of the flat cable 1 are lied on each other. The lower surface 6*a*1 of the first bus bar resin layer 6*a* is placed on the coating layer 1*a*. The lower surface 6*b*1 of the second bus bar resin layer 6*b* is also placed on the tip coating layer 1*c*. Thus, the laminated region 8 composed of the conductors 1*b*, terminal plates 2*a* and bus bars 5 is formed. Finally, the laminated region 8 is subjected to welding by ultrasonic welding to form the connection region 9. In addition, the coating layer 1*a* is sandwiched and held by the upper wall 3*a*1 and the lower surface 6*a*1. The tip coating layer 1*c* is also sandwiched and held by the second terminal resin layer 3*b* and the second bus bar resin layer 6*b*. Thus, the joint structure B is completed.

In the joint structure according to this embodiment, since the tip coating layer 1*c* of the flat cable 1 is also sandwiched by the upper wall 3*b*1 of the second terminal resin layer 3*b* and the lower wall 6*b*1 of the second bus bar resin layer 6*b*. For this reason, the strength of the joint structure B against pulling of the flat cable 1 is further increased as compared with that of the joint structure A according to the first embodiment.

EMBODIMENT 3

Figure 7:
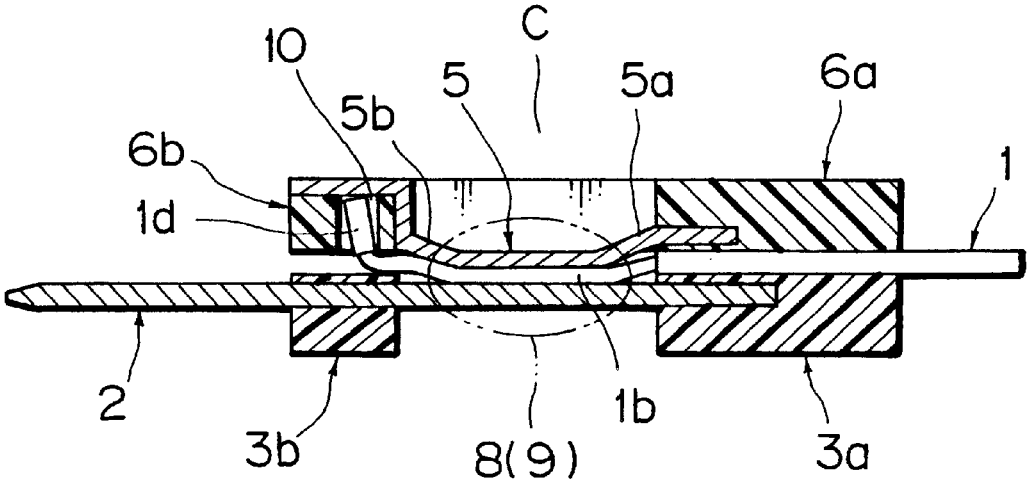
FIG. 7 is a longitudinal sectional view of a third embodiment of a joint structure of a flat cable and joint terminals according to the present invention.
Figure 8:
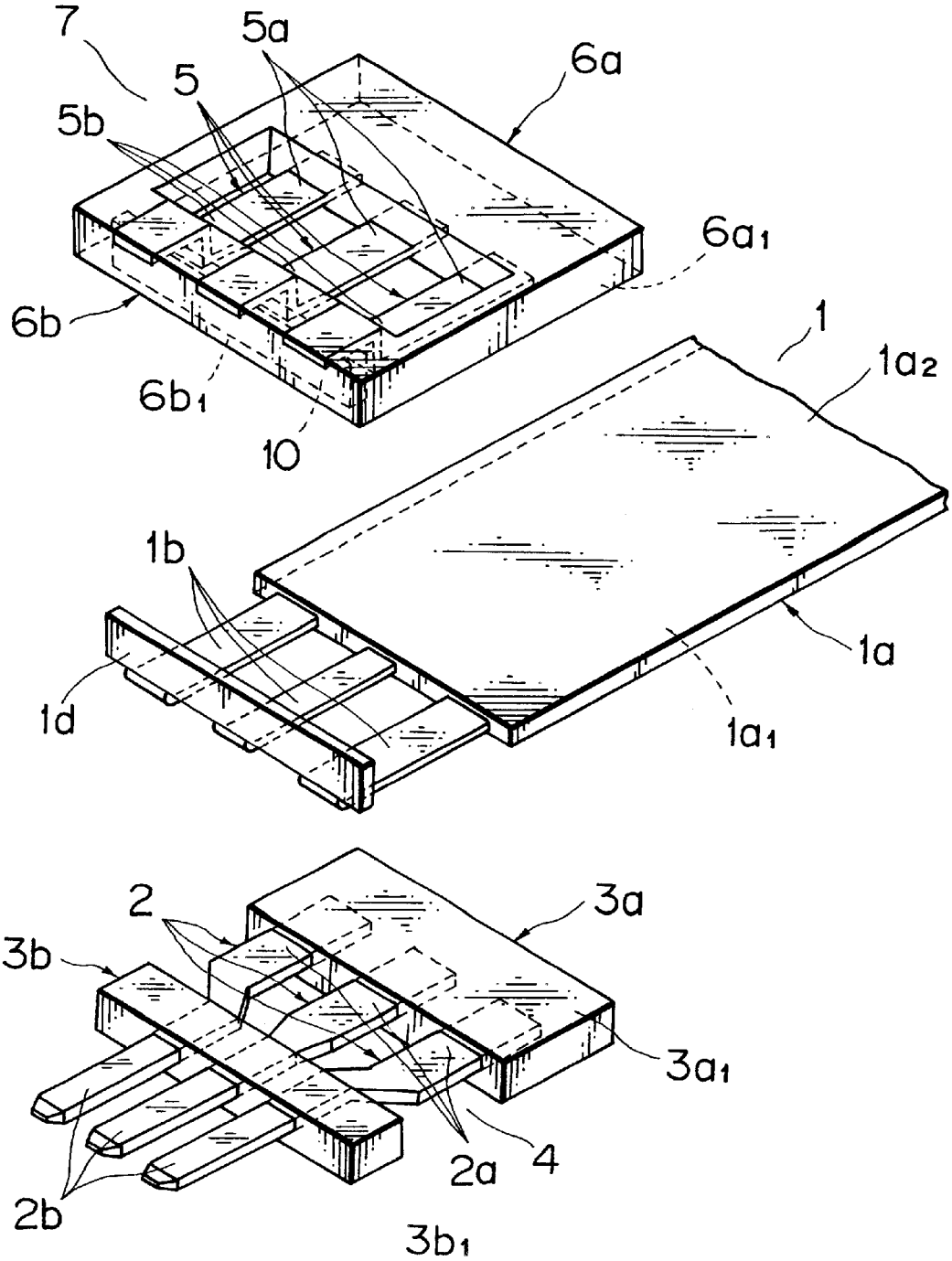
FIG. 8 is an exploded perspective new of the joint structure.
Figure 9:
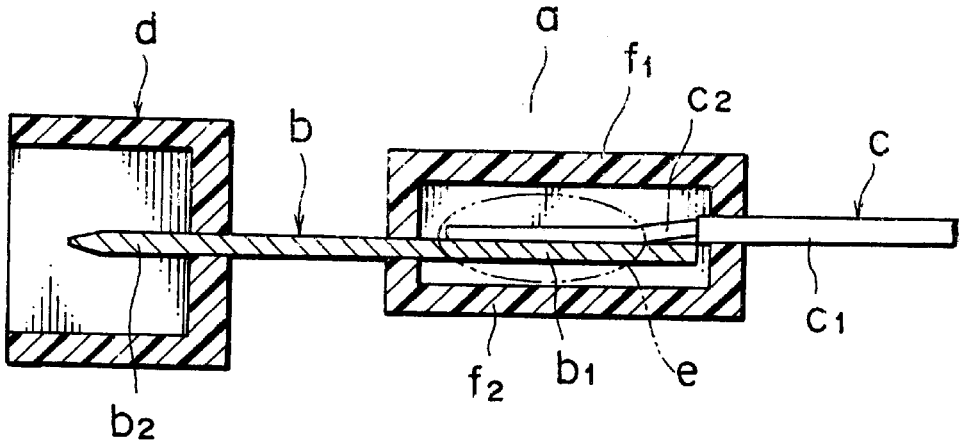
FIG. 9 PRIOR ART
FIG. 9 is a longitudinal sectional view of a conventional joint structure of a flat cable and joint terminals.
Figure 10:
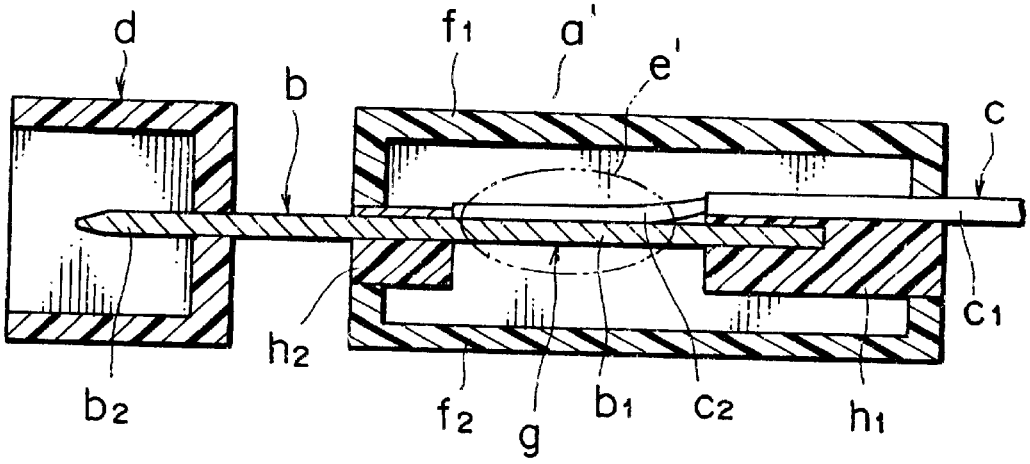
FIG. 10 PRIOR ART
FIG. 10 is a longitudinal sectional view of another conventional joint structure.

FIGS. 7 and 8 illustrate a third embodiment of a joint structure of a flat cable and joint terminals of the present invention. In the following description, the same components as in the first and second embodiments will be referred to as the same names and numbers as well, and not be described in detail.

A joint structure C shown in FIGS. 7 and 8, an insertion groove 10 is formed on the second bus bar resin layer of the bus bar holder 7. With the tip coating layer 1*d* of the flat cable 1 being inserted into the insertion groove 10, a connection region formed by welding and connecting the bus bars 5 of the bus bar holder 7, the conductors 1*b* of the flat cable 1, and the terminal plates 2*a* of the terminal holder 4. The coating layer 1*a* is interposed between the first terminal resin layer 3*a* and the first bus bar resin layer 6*a*.

The insertion groove 10 is formed on the second bus bar resin layer 6*b* on the side of the terminal holder 4 in a direction perpendicular to the longitudinal direction of the conductors 1*b* of the flat cable 1. It is also possible to form the insertion groove 10 on the second terminal resin layer 3*b* on the side of the bus bar holder 7.

The following is a description as to how the junction structure C is formed.

Firstly, the tip coating layer 1*d* of the flat cable 1 is bent toward the bus bar holder 7, and then inserted into the insertion groove 10 on the second bus bar resin layer 6*b*. By doing so, the flat cable 1 is temporarily secured to the bus bar holder 7 (hereinafter, such situation will be referred to as "temporarily secured state"). Here, the bus bars 5 of the bus bar holder 7 are arranged in conformity with the arrangement pitch of the conductors 1*b* of the flat cable 1, while the lower surface 6*a*1 of the first bus bar resin layer 6*a* is overlapped onto the upper surface 1*a*2 of the coating layer 1*a*.

The conductors 1*b* of the flat cable 1 are arranged in conformity with the arrangement pitch of the terminal plates 2*a* of the terminal holder 4, while the lower surface 1*a*1 of the coating layer 1*a* is overlapped onto the upper surface 3*a*1 of the first terminal resin layer 3*a*. By doing so, the conductors 1*b* of the flat cable 1 can be interposed between the bus bars 5 of the bus bar holder 7 and the terminals plates 2*a* of the terminal holder 4, thereby forming the laminated region 8.

The laminated regions is then ultrasonic-welded to form the connection region 9. After the formation of the connection region 9, the coating layer 1*a* is interposed between the first terminal resin layer 3*a* and the first bus bar resin layer 6*a*, so that the junction structure C can be completed, with the tip coating layer 1*d* of the flat cable 1 being inserted into the insertion groove 10 on the second bus bar resin layer 6*b*.

As described so far, after the flat cable 1 is temporarily secured to the bus bar holder 7 by inserting the tip coating layer 1*d* into the insertion groove 10, the flat cable 1 is arranged in conformity with the terminal holder 4 and then attached to the bus bar holder 7 and the terminal holder 4. Thus, there will be no gaps between the positions of the terminal holder 4 and the flat cable 1. Compared with the prior art, workability can be improved in attaching the flat cable 1 to the bus bar holder 7 and the terminal holder 4. Thus, reliability of the junction structure C can also be improved, and the productivity can be stabilized.

Since the flat cable 1 is attached to the bus bar holder 7 and the terminal holder 4 with the tip coating layer 1*d* being inserted into the insertion groove 10 on the bus bar holder 7, the thin and fragile conductors 1*b* of the flat cable 1 will not be adversely affected by the stress caused by the bus bar holder 7 and the terminal holder 4 at the time of assembling. Thus, workability in attaching the flat cable 1 to the bus bar holder 7 and the terminal holder 4 can be dramatically improved compared with the first and second embodiments.

Although the present invention has been fully described by way of example with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A joint structure of a flat cable and joint terminals comprising:

a flat cable having a plurality of conductors at its front and an insulating coating layer at its rear;

a plurality of joint terminals having terminal plates at their first ends, said terminal plates being arranged in conformity with an arrangement pitch of said conductors;

a terminal holder including a first terminal resin layer and holding said joint terminals in such a manner that the first ends of said terminal plates are secured by said first terminal resin layer; and a bus bar holder including a first bus bar resin layer and holding a plurality of bus bars which are arranged in conformity with the arrangement pitch of said conductors in such a manner that the first ends of said bus bars are secured by said first bus bar resin layer, wherein said conductors are sandwiched by and welded to said terminal plates and said bus bars held by said bus bar holder, and said insulating coating layer of said flat cable is sandwiched and secured by said first terminal resin layer and said first bus bar resin layer.

2. A joint structure according to claim 1, wherein said joint terminals are secured in a direction perpendicular to the longitudinal direction of the first terminal resin layer.

3. A joint structure according to claim 1, wherein the first ends of the terminal plates are integrally formed into the first terminal resin layer, and the first ends of said bus bars are integrally formed into the first bus bar resin layer.

4. A joint structure according to claim 1, wherein said conductors are welded to said terminal plates and said bus bars by ultrasonic welding.

5. A joint structure according to claim 1 wherein said terminal holder further includes a second terminal resin layer and holds said joint terminals in such a manner that both ends of said joint terminals are secured by said first terminal resin layer and said second terminal resin layer;

said bus bar holder further includes a second bus bar resin layer and holds said bus bars in such a manner that both ends of said bus bars are secured by said first bus bar resin layer and said second bus bar resin layer;

said flat cable has a tip insulating coating layer left at tips of said conductors; and said tip insulating coating layer is sandwiched and held by said second terminal resin layer and said second bus bar resin layer.

6. A joint structure according to claim 5, wherein said terminal plates are secured in a direction perpendicular to the longitudinal direction of the first terminal resin layer and the second terminal resin layer.

7. A joint structure according to claim 5, wherein both ends of the terminal plates are integrally formed into the first and second terminal resin layer, respectively, and both ends of said bus bars are integrally formed into the first bus bar resin layer and second bus bar resin layer, respectively.

8. A joint structure according to claim 5, wherein said conductors are welded to said terminal plates and said bus bars by ultrasonic welding.

9. A joint structure according to claim 1, wherein said terminal holder further includes a second terminal resin layer and holds said joint terminals in such a manner that both ends of said joint terminals are secured by said first terminal resin layer and said second terminal resin layer;

said bus bar holder further includes a second bus bar resin layer and holds said bus bars in such a manner that both ends of said bus bars are secured by said first bus bar resin layer and said second bus bar resin layer;

said flat cable has a tip insulating coating layer left at tips of said conductors; and said tip insulating coating layer is inserted into an insertion groove formed on said second terminal resin layer and said second bus bar resin layer.

10. A joint structure according to claim 9, wherein said terminal plates are secured in a direction perpendicular to the longitudinal direction of the first terminal resin layer and the second terminal resin layer.

11. A joint structure according to claim 9, wherein both ends of the terminal plates are integrally formed into the first and second terminal resin layer, respectively, and both ends of said bus bars are integrally formed into the first bus bar resin layer and second bus bar resin layer, respectively.

12. A joint structure according to claim 9, wherein said conductors are welded to said terminal plates and said bus bars by ultrasonic welding.

* * * * *